United States Patent [19]

Saron

[11] Patent Number: 4,517,499

[45] Date of Patent: May 14, 1985

[54] FLEXIBLE LIGHT

[75] Inventor: John R. Saron, St. Petersburg, Fla.

[73] Assignee: Key Medical, Inc., Tampa, Fla.

[21] Appl. No.: 394,478

[22] Filed: Jul. 1, 1982

Related U.S. Application Data

[63] Continuation-in-part of Ser. No. 314,721, Oct. 26, 1981, Pat. No. 4,347,553.

[51] Int. Cl.[3] ..... H05B 37/02; H05B 39/06; H05B 41/04; H05B 41/18

[52] U.S. Cl. ..... 315/362; 362/206; 362/204; 200/60

[58] Field of Search ..... 315/362; 362/204, 206, 362/205, 200, 202; 200/6 B, 60

[56] References Cited

U.S. PATENT DOCUMENTS

| | | | |
|---|---|---|---|
| 2,256,641 | 9/1941 | Fullmer | 200/60 |
| 2,503,287 | 4/1950 | Moore | 200/60 |
| 3,459,907 | 8/1969 | Garland | 200/60 |
| 3,479,561 | 11/1969 | Janning | 315/362 X |
| 4,081,632 | 3/1978 | Schaffeler | 200/6 B |
| 4,176,261 | 11/1979 | Epple | 200/6 B |

*Primary Examiner*—Saxfield Chatmon
*Attorney, Agent, or Firm*—Arthur W. Fisher, III

[57] ABSTRACT

A reusable light comprising a housing configured to operatively retain a voltage source therein having an extended bulb assembly mounted on one end thereof and a switch pivotally mounted on the opposite end thereof, the extended bulb assembly comprises an elongated hollow sleeve having a mounting member attached on one end thereof to attach the extended bulb assembly to the housing and a bulb housing having a light source disposed therein attached to the opposite end thereof, a first conductor including a first and second conductor element extending substantially the length of the flexible light coupled to the light source, a second conductor disposed within the hollow sleeve being coupled to another portion of the light source and a removable cap to selectively house the extended bulb assembly, the switch movable to operatively engage the first conductor means to selectively close the circuit and activate the light source.

1 Claim, 2 Drawing Figures

FLEXIBLE LIGHT

CO-PENDING APPLICATIONS

The present invention is a continuation-in-part application to Ser. No. 314,721, filed Oct. 26, 1981, now U.S. Pat. No. 4,347,553.

BACKGROUND OF THE INVENTION

1. Field of the Invention

A reusable flexible light comprising a housing configured to operatively retain a voltage source therein including an extended bulb assembly mounted on one end thereof and a switch pivotally attached to the opposite end thereof to electrically couple the voltage source to the extended bulb assembly.

2. Description of the Prior Art

Numerous flexible lights have been designed for medical use and similar endeavors. Naturally, these lights include a voltage source and light source with a switch means to energize the light. These lights may include extended flexible lights to permit illumination of relatively small areas. Unfortunately, many such flexible lights are complicated to manufacture and assemble.

Thus a need exists for a simple and reliable device including an integral light source/voltage source package.

Examples of prior art are disclosed in U.S. Pat. Nos.: 936,499; 1,158,600; 1,673,436; 1,855,015; 2,427,890; 2,467,954; 2,648,762; 3,103,723; 3,111,277; 3,234,356; 3,393,312; 3,862,410; 3,881,468 and France No. 643,016.

SUMMARY OF THE INVENTION

The present invention relates to a reusable flexible light comprising a housing having an extended bulb assembly and switch mounted at opposite ends thereof. A removable protective cap is removably mounted on the housing to protect the extended bulb assembly when the flexible light is not in use.

The housing includes a retainer lip and switch retainer operatively coupling the extended bulb assembly and switch thereto. A voltage source comprising one or more batteries is operatively retained within the cylindrical housing.

The extended bulb assembly comprises an elongated sleeve having a mounting member attached to one end thereof to attach the extended bulb assembly to the housing and a bulb housing having a light source disposed therein attached to the opposite end thereof.

A first conductor electrically coupled between the light source and switch extends substantially the entire length of the flexible light. A second conductor extends between the voltage source and the light source.

The switch pivotally mounted, comprises an arcuate cam member and a switch contact. As described more fully hereinafter, the switch contact is movable between a first and spaced position to operatively engage and disengage the first conductor to actuate and deactuate the flexible light.

When not in use, the removable protective cap is mounted onto the housing to enclose the extended bulb assembly. The switch is held in the first position out of contact or engagement with the first conductor while engaging the base of the voltage source.

To use, the removable protective cap is removed from the housing and the switch is pivoted to the second position to simultaneously engage both the first conductor and the base thus completing the circuit. The removable protective cap may be placed over the housing adjacent the switch to effectively extend the length of the reusuable flexible light.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
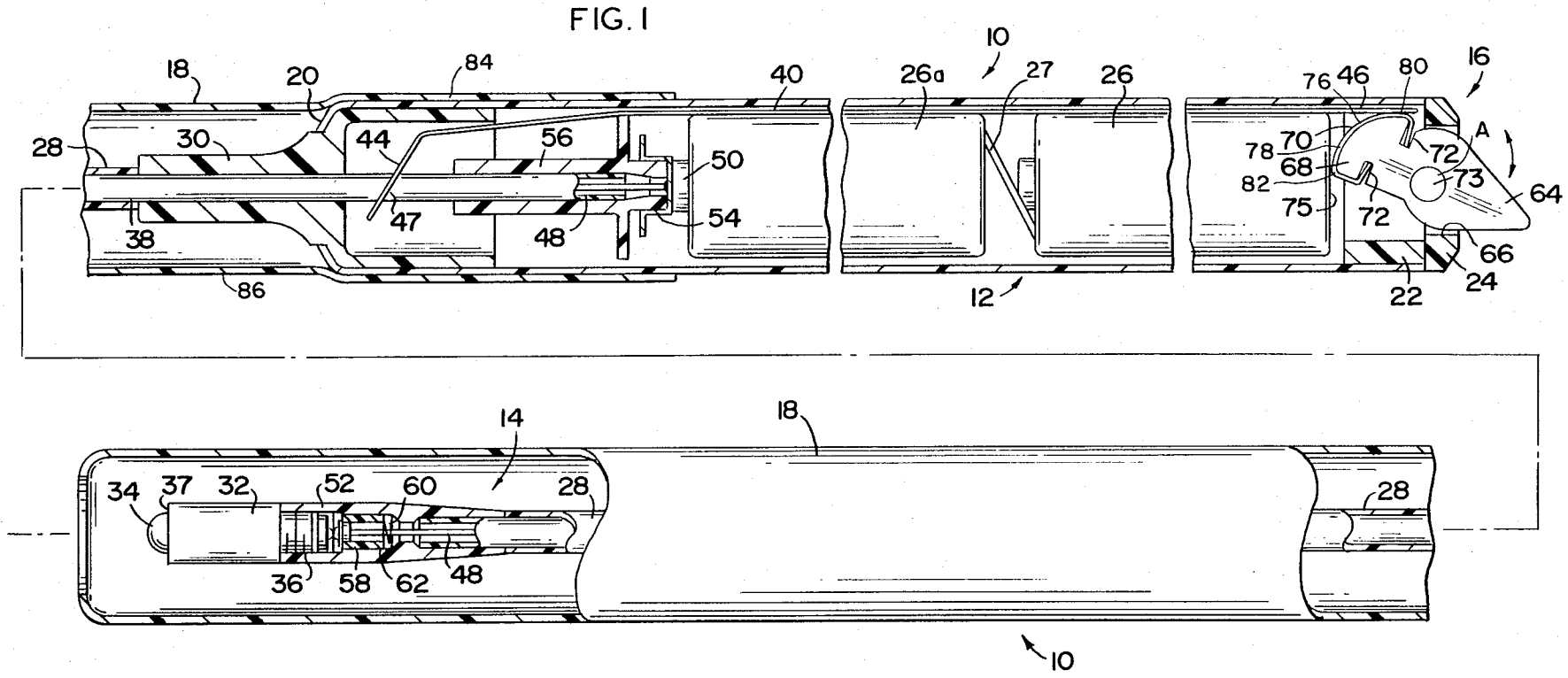
FIG. 1 is a cross-sectional side view of the flexible light.
Figure 2:
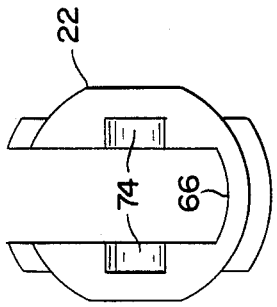
FIG. 2 is an end view of the switch actuator means.

As best shown in FIG. 1, the present invention relates to reusable flexible light generally indicated as 10. The reusable flexible light 10 comprises a hollow substantially cylindrical housing generally indicated as 12 having an extended bulb assembly and switch generally indicated as 14 and 16 respectively mounted at opposite ends thereof. A removable hollow substantially cylindrical protective cap 18 is removably mounted on the housing 12 to protect the extended bulb assembly 14 when the flexible light 10 is not in use.

The hollow substantially cylindrical housing 12 includes a retainer lip 20 and switch retainer comprising a switch housing 22 and a removable retainer cap 24 to operatively couple the extended bulb assembly 14 and switch 16 thereto. A voltage source comprising one or more batteries each indicated as 26 is operatively retained within the hollow substantially cylindrical housing 12. A bias or spring 27 is disposed between the batteries 26. Alternately the bias or spring 27 may be disposed forward of the inner battery 26*a*.

The extended bulb assembly 14 comprises an elongated hollow flexible sleeve 28 having a mounting member 30 attached to one end thereof to attach the extended bulb assembly 14 to the hollow substantially cylindrical housing 12 and a bulb housing 32 having a light source 34 disposed therein with a first recess 36 attached to the opposite end thereof. A light source retainer 37 attached the light source 34 to the bulb housing 32.

A first conductor comprising a first and second conductor element 38 and 40 respectively electrically coupled to the light source 34 extends substantially the entire length of the flexible light. The second conductor element 40 includes a first and second contact 44 and 46 respectively to selectively couple the first conductor element 38 to the switch 16 as more fully described hereinafter. The first contact 44 comprises an aperture 47 disposed in surrounding relation relative to the inner portion of the first conductor element 38.

A second conductor 48 extends between the terminal 50 of the voltage source 26 and the base 52 of the light source 34. The inner end of the second conductor 48 is held in contact with the terminal 50 by a conductor element 54 mounted on a first coupling element 56. The outer end of the second conductor 48 is held in contact with the base 52 by a second coupling element 58 biased outwardly by bias means 60 within a second recess 62.

The switch 16 comprises a body 64 extending through aperture 66, an arcuate cam member 68 and switch contact 70 operatively retained by slots or grooves 72 formed on opposite sides o the arcuate cam member 68. The switch 16 is pivotally mounted within the hollow substantially cylindrical housing by a pair of attachment members 73 extending from opposite sides of the body 64 to be received in recesses 74. As described more fully hereinafter, the switch contact 70 is movable between a first and second position to operatively engage and disengage the second contact 48 to actuate and deactuate the flexible light 10.

The switch 16 more particularly comprises a conductive switch wherein the arcuate cam member 68 comprises a compound radius having a first and second cam surface indicated as 76 and 78 respectively in combination with a first and second contact 80 and 82 respectively. As shown, the radius of curvature of the first cam surface 76 is greater than the radius of curvature of the second cam surface 78 while the distance from the center point of the first cam surface to the point of rotation indicated as A is less than the distance from the center of the second cam surface to the point of rotation A. As a result as the switch 16 is moved from the first to the second position wherein the substantially flat first contact 80 is in contact with the second contact 46 of the second conductor element 40 while the base 75 of the voltage source 26 engages the second arcuate contact 82. As a result, during the movement from the first to second position of the switch 16 the voltage source 26 is moved inwardly longitudinally within the substantially cylindrical housing 12 and forced further forward by the second cam surface 78 and coming to rest on second arcuate contact 82. This provides or insures mechanical engagement of various components to insure completion of the electric circuit and effectively locks the switch 16 in the "on" or second position. It should be noted that the second arcuate contact 82 engages the base 75 posted the longitudinal axis of the housing 12.

The removable protective cap 18 comprises an enlarged inner attachment portion 84 to engage the housing 12 and an elongated outer protective portion 86.

When not in use, the removable protective cap 18 is mounted onto the hollow substantially cylindrical housing 12 to enclose extended bulb assembly 14. The switch 16 is held in the first position out of contact or engagement with the second contact 46 while engaging the base 75 of the voltage source 26.

To use, the removable protective cap 18 is removed from the hollow substantially cylindrical housing 12 and the switch 16 is pivoted to the second position to simultaneously engage both the second contact 46 and the base 75 thus completing the circuit from the terminal post 50, second conductor 48 to the base 52 through the light source 34, first and second conductor elements 38 and 40 to second contact 46 and through switch 16 to the base 75. The removable protective cap 18 may be placed over the housing 18 adjacent the switch 16 to extend the effective length of the reusuable flexible light 10. The batteries 26 and light source 34 may be replaced by removing the removable retainer cap 24 and removable light source retainer 37 respectively.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statement of the scope of the invention which as a matter of language, might be said to fall therebetween.

Now that the invention has been described,

What is claimed is:

1. A switch for use with a hand held battery powered device such as a light wherein the hand held device comprises an outer housing configured to retain a battery voltage source therein and having a light mounted on one end thereof and said switch pivotally mounted on the opposite end thereof and a conductor element extending substantially the length of the outer housing electrically connected to the light; said switch comprising a body including an arcuate cam member having a compound radius formed thereon forming a first and second conductive cam surface, said first conductive cam surface comprising a first substantially flat contact disposed to selectively engage said conductor element and said second conductive cam surface being substantially arcuate to engage the battery voltage source, said arcuate cam member being movable between a first and second position such that said first conductive cam surface is isolated from said conductor element when said switch is in said first position to deactivate the light and said first conductive cam surface engages said conductor element when in said second position to couple said conductor element to the battery voltage source to actuate the light, said second conductive cam surface engaging the battery voltage source off center relative to the longitudinal axis thereof opposite said conductor element when said switch is in said first position to lock said switch in said first position and engaging the battery voltage source off center relative to the longitudinal axis thereof adjacent said conductor element when said switch is in said second position to lock said switch in said second position.

* * * * *